US009925436B1

(12) United States Patent
Marlow

(10) Patent No.: US 9,925,436 B1
(45) Date of Patent: Mar. 27, 2018

(54) CLUB MARKING CLOTH

(71) Applicant: John Charles Marlow, Ft. Collins, CO (US)

(72) Inventor: John Charles Marlow, Ft. Collins, CO (US)

(73) Assignee: John C Marlow, Forst Collins, CO (US)

( * ) Notice: Subject to any disclaimer, the term of this patent is extended or adjusted under 35 U.S.C. 154(b) by 0 days.

(21) Appl. No.: 15/410,073

(22) Filed: Jan. 19, 2017

(51) Int. Cl.
*A63B 57/00* (2015.01)
*A63B 57/35* (2015.01)
*A63B 55/00* (2015.01)

(52) U.S. Cl.
CPC ..... *A63B 57/35* (2015.10); *A63B 55/00* (2013.01)

(58) Field of Classification Search
CPC ..... A63B 57/35; A63B 55/00
See application file for complete search history.

(56) References Cited

U.S. PATENT DOCUMENTS 4,418,881 A * 12/1983 Bouldin ..... B64F 1/12 244/1 R
4,887,543 A * 12/1989 Rockhill ..... A45B 9/06 116/201
5,046,446 A * 9/1991 Sumrall ..... A45B 25/00 116/200
5,388,546 A * 2/1995 Lombard ..... B60Q 1/482 116/173
5,581,018 A * 12/1996 Allen ..... G01M 3/2853 138/90
6,115,872 A 9/2000 Welsh
6,626,293 B2 * 9/2003 St. Jeor ..... A63B 57/00 116/173
7,322,068 B1 1/2008 Kim
D627,847 S * 11/2010 Leoni ..... D21/789
D708,284 S * 7/2014 Litwin ..... D21/789
8,851,090 B2 10/2014 Bradshaw
9,162,123 B2 * 10/2015 Enright ..... A63B 55/408
2005/0217048 A1 10/2005 Elie
2006/0086307 A1 * 4/2006 Kaz ..... G09F 21/04 116/28 R
2007/0093311 A1 * 4/2007 Fletcher ..... A63B 55/10 473/282
2010/0192837 A1 * 8/2010 Leoni ..... G09F 3/08 116/307
2011/0131742 A1 6/2011 Cheung

FOREIGN PATENT DOCUMENTS

JP 2001336120 A * 12/2001

* cited by examiner

*Primary Examiner* — Stephen Blau
(74) *Attorney, Agent, or Firm* — Robert Larry

(57) ABSTRACT

An club marking cloth comprised of a square piece of material. In at least one corner of the material a powerful magnet is attached. The powerful magnet allows the club marking cloth to be attached to the metal head of a golf club. The club marking cloth can be either attached to clubs left in the golf bag to indicate that clubs have been removed, or, can be attached to the head of clubs left in the grass so that the club is easier to see and find for the golfer.

5 Claims, 1 Drawing Sheet

CLUB MARKING CLOTH

CROSS-REFERENCE TO RELATED APPLICATIONS

Not Applicable

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to golf accessories, and, in particular, to a club marking cloth intended to prevent the loss of golf clubs on a golf course. Often on a golf course multiple clubs are carried away from the golf bag (generally a putter and a wedge). Once the golfer finishes with the wedge it is often left on the edge of the green while the golfer finishes up with the putter. Due to longer grasses surrounding most greens, golfers sometimes forget about the wedge and continue to the next hole.

SUMMARY OF THE INVENTION

Accordingly, the present invention provides a club marking cloth with will help golfers to remember clubs which are left outside of the golf bag. The cloth provides a magnet on one of the corners of the cloth such that the cloth may be attached to the metal head of a club. When the golfer removes clubs from the bag for use, the cloth is either attached to a club remaining in the bag or can be carried with the golfer to be attached to the club left in the grass. This cloth provides the golfer with a reminder that they have a club somewhere on the course.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
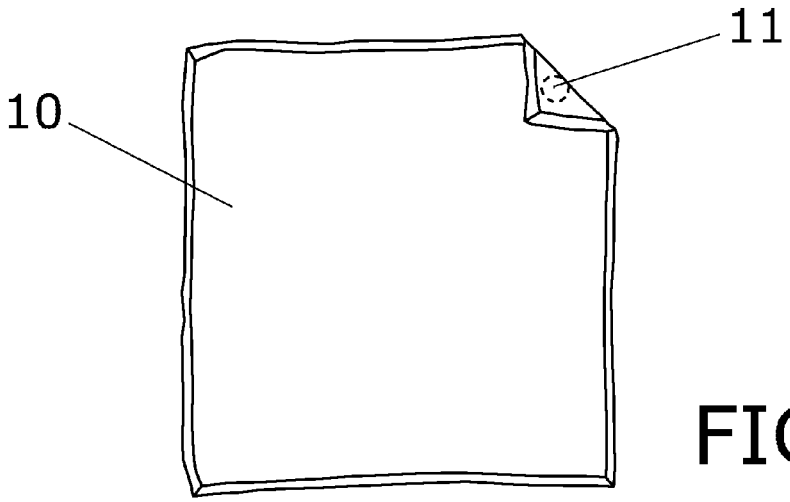
FIG. 1 shows a front view of the first exemplary embodiment with the cloth 10 and magnet 11.
Figure 2:
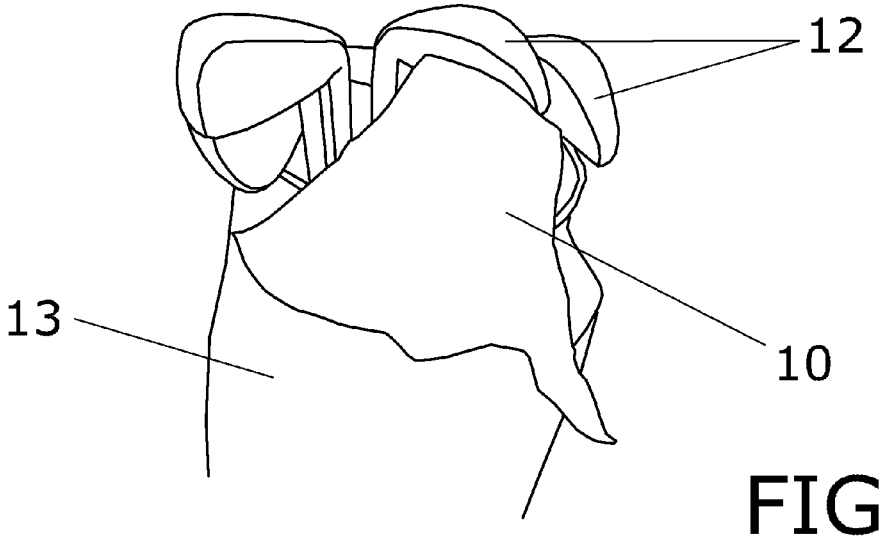
FIG. 2 shows a front perspective view of the first exemplary embodiment, displaying the cloth 10 attached to a golf club 12 in a golf bag 13.

Referring now to the invention in more detail, the invention is directed to a club marking cloth 10. The first exemplary embodiment is comprised of a club marking cloth 10 which is preferably square in shape and made of a nine-inch by nine-inch piece of fabric material. The material is preferably satin and brightly colored so that it is easy to see by a user. The club marking cloth could be provided in a wide range of sizes and materials which provide sufficient visibility of the club marking cloth 10 in use of a golf course.

In at least one corner of the square club marking cloth 10 a powerful magnet 11 is attached. The powerful magnet 11 can be attached in any appropriate way but is preferably glued onto the cloth. However, the magnet could also be embedded within the cloth itself. The powerful magnet 11 is used to attach the cloth to the metal head of a golf club 12. The magnet 11 should provide sufficient magnetic attraction to hold the club marking cloth in place but be easily removable without separating the magnet from the cloth itself.

To use the first exemplary embodiment the user removes whichever clubs 12 are needed for the current shot. This may include one or more clubs 12 depending on the situation the golfer is in. For instance, if the golfer is close to the green, the golfer may require a wedge as well as their putter. Once the necessary clubs 12 have been removed, the golfer attaches the club marking cloth 10 to a club 12 remaining in the golf bag 13 via the magnet 11. When the golfer finishes their shot they return the used clubs 12 to the golf bag 13. The club marking cloth 10 serves as a reminder that clubs 12 have been removed from the bag 13. When the golfer sees the club marking cloth 10 attached to a club 12 in the bag 13 they are visually reminded that clubs 12 have been removed. If they forgot a club 12 somewhere on the course they are able to go back and find the club 12.

Alternatively, the first exemplary embodiment can be used in another way. When the user removes clubs 12 for the current shot, the golfer carries the club marking cloth 10 with them. If the golfer needs to set a club 12 down in the grass, they attach the club marking cloth 10 to the head of the club 12 first. The club marking cloth 10 would be easier to see in tall grass than a club 12 and therefore serves as an easier way to see the clubs 12 location when the golfer finishes the hole and is looking for their club 12.

Components, component sizes, and materials listed above are preferable, but artisans will recognize that alternate components or materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A method of using a club marking cloth, comprising:

(a) a piece of fabric material;

(b) said piece of fabric material being square in shape and having four corners;

(c) at least one magnet;

(d) said at least one magnet being attached to said piece of fabric material in one of said four corners;

(e) a golf bag;

(f) said golf bag containing at least one golf club and the method of:

(g) removing one or more golf clubs from said golf bag;

(h) using one of said one or more golf clubs removed from said bag;

(i) attaching said piece of fabric material, via said magnet, to said one golf club used of said one or more golf clubs removed from said bag;

(j) placing said one golf club used of said one or more golf clubs removed from said bag on the ground;

(k) continuing to play;

(l) seeing said piece of fabric material attached to said golf club placed on the ground;

(m) retrieving the golf club placed on the ground;

(n) removing said piece of fabric material from said golf club; and (o) returning said golf club to said golf bag.

2. The club marking cloth of claim 1, wherein said piece of fabric material is at least nine inches by nine inches in dimension.

3. The club marking cloth of claim 1, wherein said magnet is attached to said piece of fabric material by gluing said magnet to said piece of fabric material.

4. The club marking cloth of claim 1, wherein said magnet is attached to said piece of fabric material by embedding said magnet within said piece of fabric material.

5. The club marking cloth of claim 1, wherein said piece of fabric material is satin and brightly colored.

* * * * *